US012758034B2

(12) United States Patent
Tan et al.

(10) Patent No.: US 12,758,034 B2
(45) Date of Patent: Oct. 13, 2026

(54) CHILD CARRIER

(71) Applicant: Wonderland Switzerland AG, Steinhausen (CH)

(72) Inventors: Qingmei Tan, Dongguan (CN); Xiong Yu, Dongguan (CN); Huan Yin, Dongguan (CN); Liuhui Hu, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 225 days.

(21) Appl. No.: 18/660,632

(22) Filed: May 10, 2024

(65) Prior Publication Data

US 2024/0374051 A1 Nov. 14, 2024

(30) Foreign Application Priority Data

May 12, 2023 (CN) ..... 202310539752.4

(51) Int. Cl.
*A47D 13/02* (2006.01)
*A47D 9/00* (2006.01)
*A47D 15/00* (2006.01)

(52) U.S. Cl.
CPC ..... *A47D 13/027* (2022.08); *A47D 9/005* (2013.01); *A47D 15/001* (2013.01)

(58) Field of Classification Search
CPC ..... A47D 13/00; A47D 13/02; A47D 13/027; A47D 9/00; A47D 9/005; A47D 9/008;
(Continued)

(56) References Cited

U.S. PATENT DOCUMENTS 12,538,991 B1 * 2/2026 Schuch ..... A47G 9/04
2002/0092094 A1 * 7/2002 Welsh, Jr. ..... A47D 13/063 5/95

(Continued)

FOREIGN PATENT DOCUMENTS

CN 203106468 U 8/2013
CN 206228082 U 6/2017

(Continued)

OTHER PUBLICATIONS

"First Office Action Issued in Corresponding Japanese Patent Application No. 2024-077546", Mailed Date: Jul. 8, 2025, 10 pages.

(Continued)

*Primary Examiner* — George Sun
(74) *Attorney, Agent, or Firm* — Volpe Koenig

(57) ABSTRACT

The present disclosure relates to a child carrier, including a frame body, a cushion, and a fixing structure. The cushion includes a first usage surface and a second usage surface that are arranged oppositely. The fixing structure includes a first connecting member and a second connecting member that are detachably connected. The first connecting member is arranged on the frame body, and the second connecting member is arranged on the cushion. The second connecting member is switchable between a first usage state and a second usage state. The second connecting member is connected to the first connecting member when being in the first usage state, to expose the first usage surface for use; and the second connecting member is connected to the first connecting member when being in the second usage state, to expose the second usage surface for use.

17 Claims, 13 Drawing Sheets

(58) Field of Classification Search
CPC ..... A47D 9/012; A47D 9/016; A47D 15/00; A47D 15/001
See application file for complete search history.

(56) References Cited

U.S. PATENT DOCUMENTS

| | | | | |
|---|---|---|---|---|
| 2003/0070229 | A1* | 4/2003 | Hsia | A47D 13/063 5/95 |
| 2004/0154099 | A1* | 8/2004 | Waters | A47G 9/0253 5/655 |
| 2009/0056013 | A1* | 3/2009 | Hartenstine | A47D 9/016 5/93.1 |
| 2009/0070932 | A1* | 3/2009 | Min | A47G 9/04 5/502 |
| 2009/0077742 | A1* | 3/2009 | Burns | A47D 9/016 5/99.1 |
| 2013/0312178 | A1* | 11/2013 | Jackson | A47D 9/016 5/93.1 |
| 2014/0259393 | A1* | 9/2014 | Clute | A47D 9/012 5/98.1 |
| 2016/0095448 | A1* | 4/2016 | Waters | A47G 9/0253 5/699 |
| 2018/0035821 | A1* | 2/2018 | Bass-Conn | A47D 9/00 |
| 2019/0090665 | A1* | 3/2019 | Tak | A47G 9/04 |
| 2019/0200779 | A1* | 7/2019 | Choi | A47D 7/00 |
| 2021/0137280 | A1* | 5/2021 | Villano | A47D 15/008 |

FOREIGN PATENT DOCUMENTS

| | | | |
|---|---|---|---|
| JP | H10-117889 | A | 5/1998 |
| JP | 2003-144273 | A | 5/2003 |
| JP | 2005-329081 | A | 12/2005 |
| JP | 3212236 | U | 8/2017 |
| JP | 2019-50931 | A | 4/2019 |
| JP | 2019-526366 | A | 9/2019 |
| JP | 2023-60519 | A | 4/2023 |
| TW | 346800 | U | 12/1998 |

OTHER PUBLICATIONS

Office Action issued in counterpart Taiwan Patent Application No. 113117189 dated Aug. 19, 2024, 12 pages, including partial English Translation.

Notice of Allowance in corresponding Japanese Application No. 2024-077546 dated Feb. 25, 2026, 6 pages.

* cited by examiner

CHILD CARRIER

CROSS-REFERENCE TO RELATED APPLICATIONS

This application claims priority to Chinese patent application No. 2023105397524, filed on May 12, 2023, the content of which is hereby incorporated by reference in its entirety.

TECHNICAL FIELD

The present disclosure relates to the technical field of child carriers.

BACKGROUND

Child carriers, such as cribs, strollers, swings and child safety seats, provide convenience for children to sleep, rest and travel. A child carrier generally includes a frame body and a cushion laid or covered on the frame body. Such kind of cushion can provide a child with comfort and some cushioning and protection. In order to ensure that the cushion can be used comfortably by the child in different seasons, some cushions can be used on both surfaces, for example, one surface is made softer and thicker for the child to use in winter, and the other surface is made harder and breathable for the child to use in summer. However, it is difficult for this kind of cushion to be firmly fixed to the frame body for use when either one of the both surfaces thereof being exposed for use.

SUMMARY

According to various embodiments, a child carrier is provided.

A child carrier includes a frame body, a cushion, and a fixing structure. The cushion is provided on the frame body and includes a first usage surface and a second usage surface that are arranged oppositely. The fixing structure includes a first connecting member provided on the frame body and a second connecting member provided on the cushion. The first connecting member is detachably connected to the second connecting member. The second connecting member is capable of switching between a first usage state and a second usage state. When the second connecting member is in the first usage state, the second connecting member is connected to the first connecting member to expose the first usage surface; and when the second connecting member is in the second usage state, the second connecting member is connected to the first connecting member to expose the second usage surface.

In an embodiment, when the second connecting member is in the first usage state, the second connecting member is located on the second usage surface; when the second connecting member is in the second usage state, the second connecting member is located on the first usage surface.

In an embodiment, the cushion includes the cushion includes a corner. The second connecting member is strip-shaped. Two ends of the second connecting member are fixed to two edges forming the corner, respectively. A middle portion of the second connecting member is capable of crossing over the corner to be switched between the first usage state and the second usage state.

In an embodiment, at least two second connecting members are provided, at least two corners are provided, and two ends of each second connecting member are fixed to the two edges forming the corresponding corner, respectively.

In an embodiment, the two ends of the second connecting member are sewn to the two edges forming the corner, respectively.

In an embodiment, a first fitting member and a second fitting member are provided on opposite sides of the second connecting member respectively. The first fitting member and the second fitting member are detachably connected to the first connecting member.

In an embodiment, the first fitting member and the second fitting member are loop sides of Velcro, and the first connecting member is a hook side of Velcro. Or, the first fitting member and the second fitting member are hook sides of Velcro, and the first connecting member is a loop side of Velcro. Or, the first fitting member and the second fitting member are female buckles, and the first connecting member is a male buckle. Or, the first fitting member and the second fitting member are male buckles, and the first connecting member is a female buckle. Or, the first fitting member and the second fitting member are rings, and the first connecting member is a hook. Or, the first fitting member and the second fitting member are hooks, and the first connecting member is a ring.

In an embodiment, the second connecting member includes a third fitting member. When the second connecting member is in the first usage state or the second usage state, the third fitting member is detachably connected to the first connecting member.

In an embodiment, the first connecting member is a button, and the third fitting member is a buttonhole fitted with the button.

In an embodiment, the first connecting member is a hook side of Velcro, and the second connecting member is made of a material that is capable of being bonded to the hook side of Velcro.

In an embodiment, the second connecting member is made of nylex.

In an embodiment, the second connecting member is strip-shaped. One end of the second connecting member is connected to the cushion, and another end of the second connecting member is a free end. The child carrier further includes a fourth fitting member and a fifth fitting member that are spaced apart and provided on the second connecting member. The first connecting member is a ring-shaped member provided on the frame body. When the second connecting member is in the first usage state or the second usage state, the free end extends through and is fixed to the ring-shaped member through a detachable connection of the fourth fitting member and the fifth fitting member.

In an embodiment, one of the fourth fitting member and the fifth fitting member is a male buckle, and another of the fourth fitting member and the fifth fitting member is a female buckle. Or, one of the fourth fitting member and the fifth fitting member is a button, and another of the fourth fitting member and the fifth fitting member is a buttonhole. Or, one of the fourth fitting member and the fifth fitting member is a hook side of Velcro, and another of the fourth fitting member and the fifth fitting member is a loop side of Velcro.

In an embodiment, the child carrier is a crib, and the frame body is a hammock.

In an embodiment, the child bed further includes a bed frame and a shielding member. The bed frame includes a guard rod and an operating joint. The hammock is suspended inside the bed frame. The operating joint is configured to collapse the guard rod or adjust a height of the guard rod. The shielding member can selectively shield the operating joint.

In an embodiment, the shielding member is connected to the guard rod and is capable of being flipped.

In an embodiment, the guard rod is wrapped by a cloth cover. A side of the shielding member is sewn to the cloth cover.

In an embodiment, a first fixing member is provided on the shielding member, and a second fixing member is provided on the operating joint. When the shielding member shields a surface of the operating joint facing an outer side of the bed frame, the first fixing member is detachably connected to the second fixing member to fix the shielding member to the surface of the operating joint facing the outer side of the bed frame.

In an embodiment, the first fixing member is a first magnetic member, and the second fixing member is a second magnetic member capable of attracting the first magnetic member. Or, one of the first fixing member and the second fixing member is a hook side of Velcro, and another of the first fixing member and the second fixing member is a loop side of Velcro that is capable of being bonded to the hook side of Velcro. Or, one of the first fixing member and the second fixing member is a male buckle, and another of the first fixing member and the second fixing member is a female buckle that is capable of being buckled to the male buckle.

In an embodiment, the shielding member is provided with a magnetic member, and the operating joint is made of ferromagnetic material. When the shielding member shields a surface of the operating joint facing an outer side of the bed frame, the magnetic member cooperates with the operating joint to fix the shielding member to the surface of the operating joint facing the outer side of the bed frame.

The details of one or more embodiments of the present disclosure are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

ILLUSTRATION FOR REFERENCE SIGNS

1, frame body; 2, cushion; 21, first usage surface; 22, second usage surface; 23, corner; 24, edge; 3, fixing structure; 100, first connecting member; 100*a*, hook side of Velcro; 100*b*, Male buckle; 100*c*, Button; 100*d*, ring-shaped member; 200, second connecting member; 210, free end; 300, first fitting member; 300*a*, loop side of Velcro; 300*b*, female buckle; 400, second fitting member; 400*a*, loop side of Velcro; 400*b*, female buckle; 500, third fitting member; 500*a*, buttonhole; 600, fourth fitting member; 600*a*, male buckle; 600*b*, button; 600*c*, hook side of Velcro; 700, fifth fitting member; 700*a*, female buckle; 700*b*, buttonhole; 700*c*, loop side of Velcro; 4, Bed frame; 41, guard rod; 42, support column; 43, operating joint; 5, shielding member; 6, cloth cover; 7, magnetic member.

DETAILED DESCRIPTION OF THE EMBODIMENTS

In order to make the objects, technical solutions and advantages of the present disclosure more clear, the present disclosure will be further described in detail below in conjunction with the accompanying drawings and specific embodiments. It should be understood that the specific embodiments described here are only used to illustrate the present disclosure and do not limit the scope of the present disclosure.

It should be noted that when an element is referred to as being "fixed to" another element, it can be directly fixed on the other element or indirectly fixed on the other element by means of an intermediate element. When an element is said to be "connected to" another element, it can be directly connected to the other element or indirectly connected to the other element by means of an intermediate element. The terms "vertical", "horizontal", "left", "right" and similar expressions used herein are for illustrative purposes only and do not represent the unique implementations.

Unless otherwise defined, all technical and scientific terms used herein have the same meaning as commonly understood by one of ordinary skill in the technical field to which the present disclosure belongs. The terms used herein in the description of the present disclosure is for the purpose of describing specific embodiments only and is not intended to limit the present disclosure. As used herein, the term "and/or" includes any and all combinations of one or more of the associated listed items.

Figure 1:
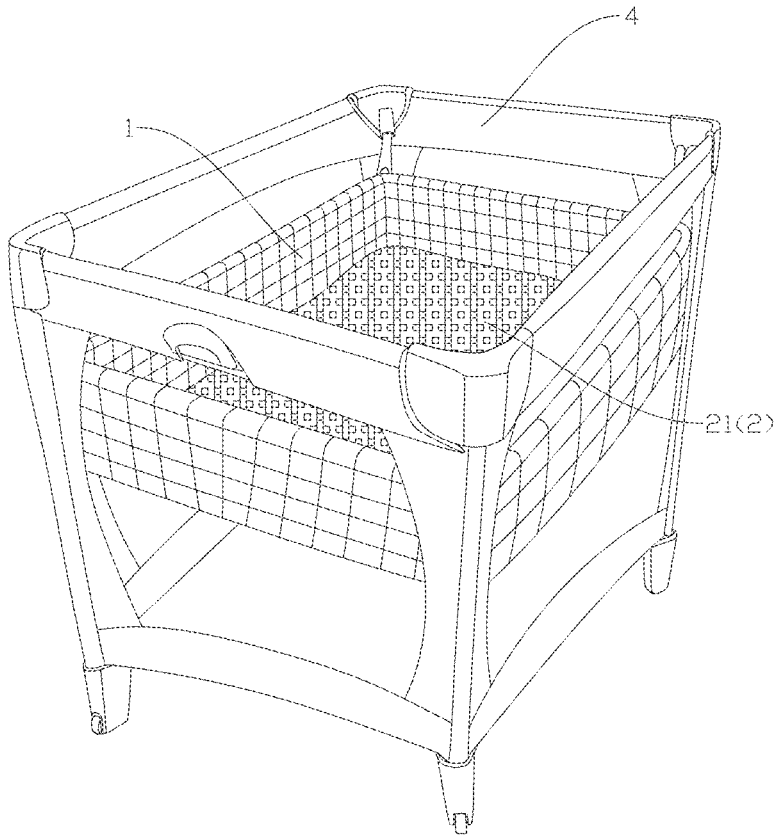
FIG. 1 is a perspective view of a child carrier according to a first embodiment of the present disclosure.
Figure 2:
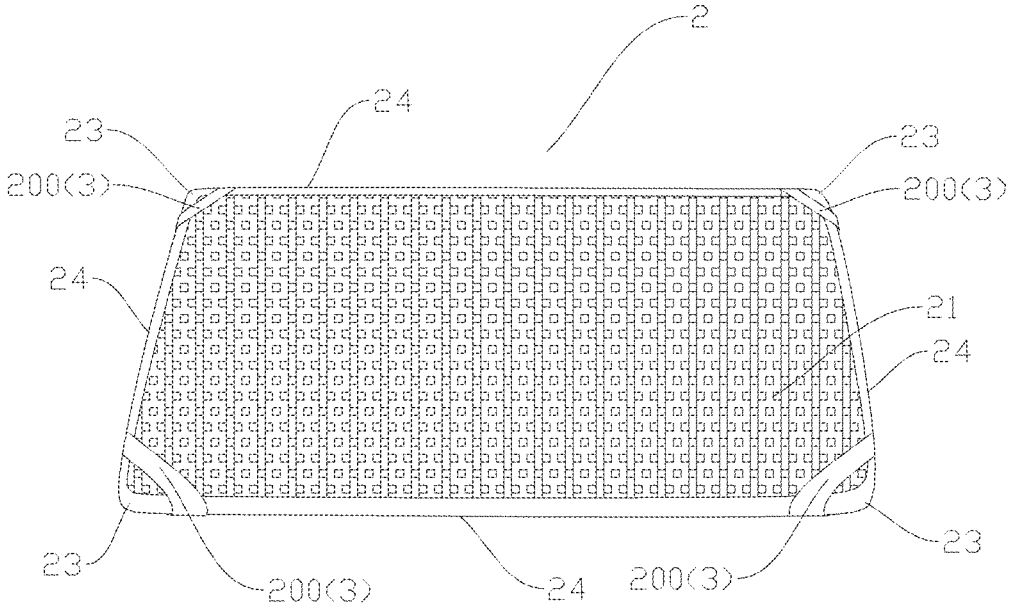
FIG. 2 is a perspective view of a cushion shown in FIG. 1, with a first usage surface of the cushion facing upward.
Figure 3:
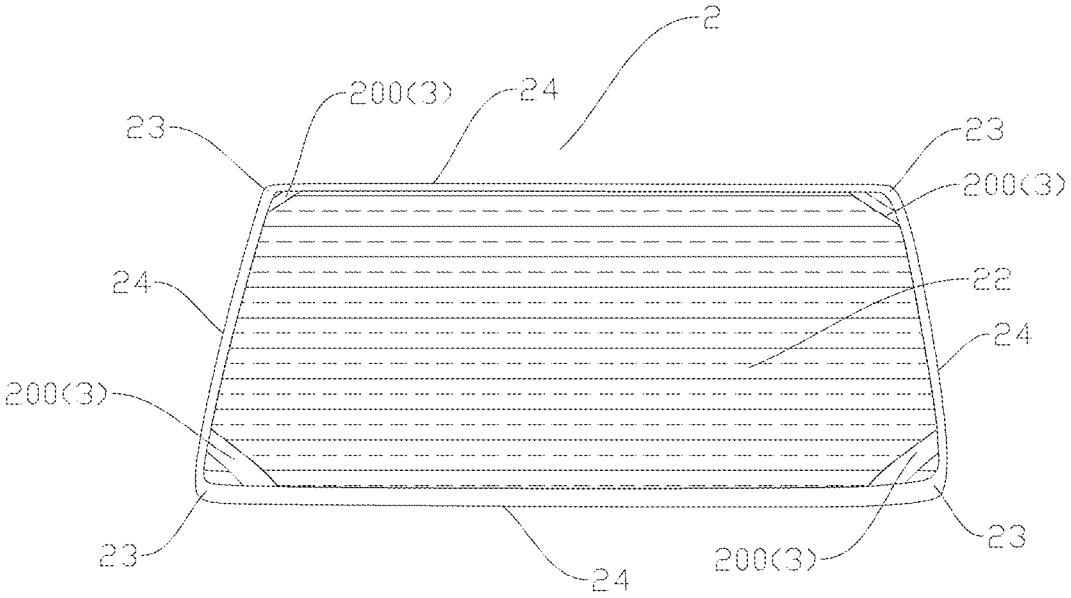
FIG. 3 is another perspective view of the cushion shown in FIG. 2, with a second usage surface facing upward.

An embodiment of the present disclosure provides a child carrier, which may be, for example, a crib, a stroller, a child dining chair, a swing, a child safety seat, etc. As shown in FIGS. 1 to 3, in this embodiment, the child carrier is described taking a crib as an example. The child carrier includes a frame body 1, a cushion 2, a fixing structure 3, and a bed frame 4. The cushion 2 is provided on, for example, laid or wrapped on a surface of the frame body 1 to provide a more comfortable use experience for children. In this embodiment, the frame body 1 may be a hammock suspended inside the bed frame 4 of the crib. In other embodiments, in a crib without a hammock, the frame body 1 may also be directly the bed frame 4. In the embodiment where the child carrier is a stroller, the frame body 1 may also be, for example, a stroller frame. In the embodiment where the child carrier is a child dining chair, the frame body 1 may also be, for example, a dining chair body.

In this embodiment, as shown in FIGS. 2 and 3, the cushion 2 is a mattress laid flat on the bottom of the frame body 1 (or, hammock). The cushion 2 includes a first usage surface 21 and a second usage surface 22 that are arranged oppositely. The first usage surface 21 can be made of a relatively hard and breathable material, such as gel ice beads material, bamboo woven material or rattan woven material, etc., which can be used in hot summer. The second usage surface 22 can be made of a relatively soft and comfortable material, such as knitted fabric filled with foam or sponge, which can be used in cold winter. In other embodiments, the first usage surface 21 and the second usage surface 22 are not limited to thereto. For example, the first usage surface 21 and the second usage surface 22 can also have different colors and patterns for the user to match different child bedding. Alternatively, the first usage surface 21 may be a surface with a common pattern, and the second usage surface 22 may be a surface with a checkerboard pattern, a train track pattern, or a puzzle pattern (such as numbers, letters, etc.). When the child carrier is a play bed, the second usage surface 22 can be used to expand the use scenarios of the crib and adding fun to children.

The cushion 2 in this embodiment is a quadrilateral cushion that fits the bottom shape of the frame body 1. The cushion 2 has four corners 23. In other embodiments, the cushion 2 may also be in other shapes, such as ellipse, circle, trapezoid, etc.

In the embodiment where the child carrier is a stroller, the cushion 2 may be a seat cushion provided in the child's sitting and lying area. In the embodiment where the child carrier is a child dining chair, the cushion 2 may be a seat cushion laid on the seating area of the dining chair.

Further, as shown in FIGS. 2 to 5, the fixing structure 3 includes a first connecting member 100 and a second connecting member 200 that are detachably connected to each other. The first connecting member 100 is arranged on the frame body 1, and the second connecting member 200 is arranged on the cushion 2. The second connecting member 200 is switchable between a first usage state and a second usage state. When the second connecting member 200 is in the first usage state, the second connecting member 200 can be connected to the first connecting member 100 to expose the first usage surface 21 of the cushion 2 for use. In other words, the first usage surface 21 being exposed upwardly in the crib for contact with the child. When the second connecting member 200 is in the second usage state, the second connecting member 200 can be connected to the first connecting member 100 to expose the second usage surface 22 of the cushion 2 for use. In other words, the second usage surface 22 being exposed upwardly in the crib for contact with the child. In this way, the cushion 2 can be firmly fixed to the frame body 1 for use regardless of whether the first usage surface 21 or the second usage surface 22 is exposed upwardly, which improves a user experience.

Specifically, the first connecting member 100 and the second connecting member 200 may have multiple structural forms. For example, as shown in FIGS. 2 to 13, when the second connecting member 200 is in the first usage state, the second connecting member 200 is located on the second usage surface 22 of the cushion 2. When the second connecting member 200 is in the second usage state, the second connecting member 200 is located on the first usage surface 21 of the cushion 2. Specifically, the second connecting member 200 is strip-shaped. Two ends of the second connecting member 200 are respectively fixed to the two edges 24 forming the same corner 23 of the cushion 2. Specifically, the two ends of the second connecting member 200 are sewn and fixed to the junction of the first usage surface 21 and the second usage surface 22 of the cushion 2, respectively. In other embodiments, the two ends of the second connecting member 200 may also be sewn and fixed to the first usage surface 21 and the second usage surface 22 of the cushion 2, respectively. A middle portion of the second connecting member 200 can cross over the corner 23 of the cushion 2 to be switched between the first usage state and the second usage state. Specifically, the second connecting member 200 can be made of a material with a certain elasticity, so that the second connecting member 200 can be pulled and deformed to easily cross over the corner 23 of the cushion 2. The second connecting member 200 may also be made of general cloth material, and the deformation of the seat cushion and the second connecting member 200 itself can allow the second connecting member 200 to cross over the corner 23 of the cushion 2.

Optionally, one or more second connecting members 200 are provided. One or more corners 23 are also provided, the second connecting members 200 correspond to the corners 23 one by one. The two ends of the second connecting member 200 are respectively fixed to the two edges 24 of the cushion 2 forming the corresponding corner 23 respectively. In this embodiment, the cushion 2 includes four corners 23, and four second connecting members 200 are provided. The two ends of the each of the four second connecting members 200 are respectively fixed to the two edges 24 forming the corresponding corner 23 of the cushion 2. The corners 23 may be right-angled, rounded or beveled, and which are not limited to thereto.

Figure 4:
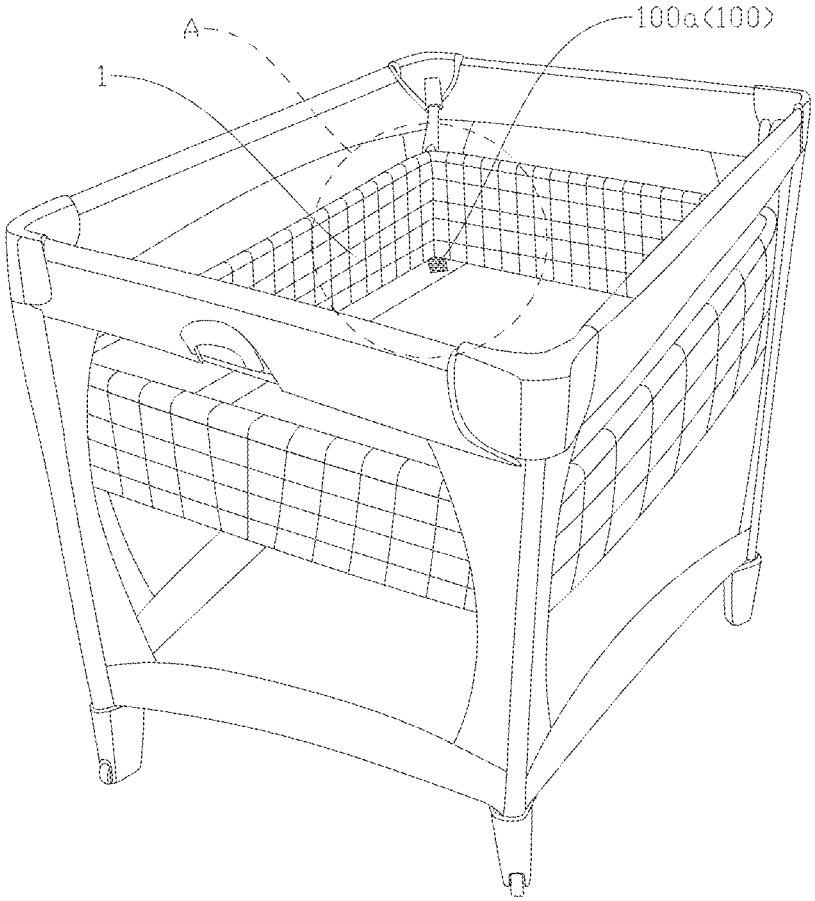
FIG. 4 is a perspective view of the child carrier shown in FIG. 1 after removing the cushion.
Figure 5:
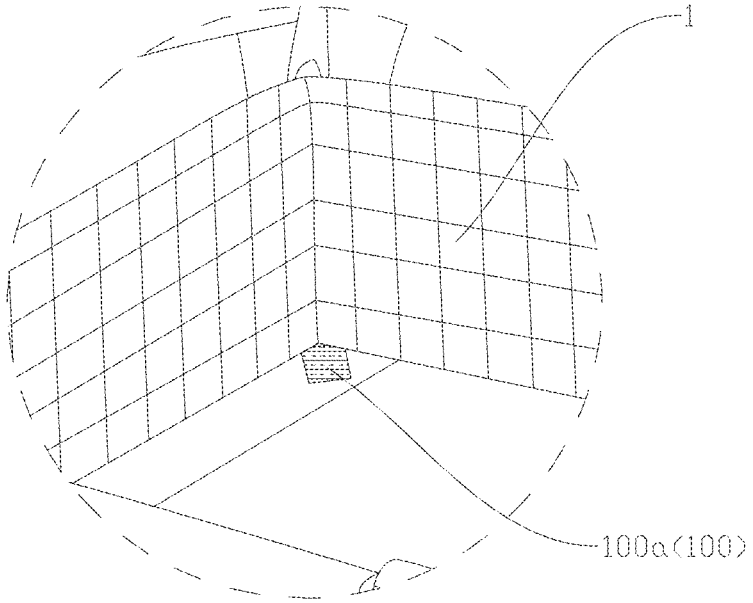
FIG. 5 is an enlarged view of portion A in FIG. 4.
Figure 6:
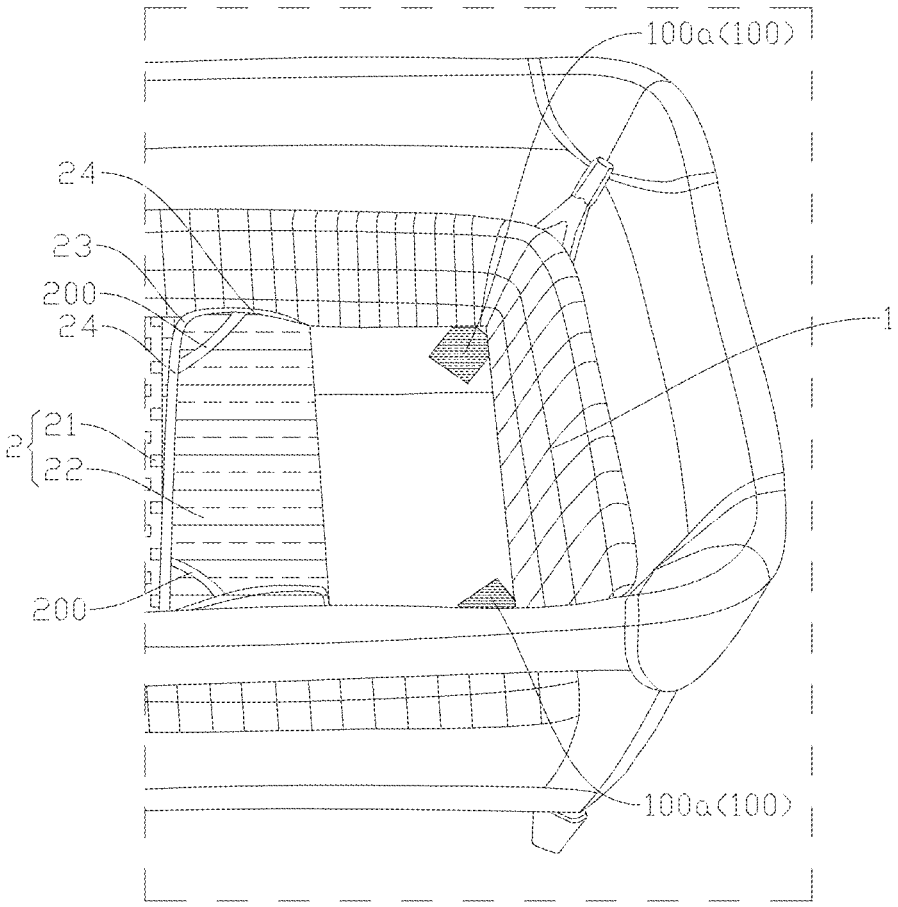
FIG. 6 is a partial perspective view of the child carrier shown in FIG. 1, with a first usage surface of a cushion being exposed for use and the cushion partially being folded.
Figure 7:
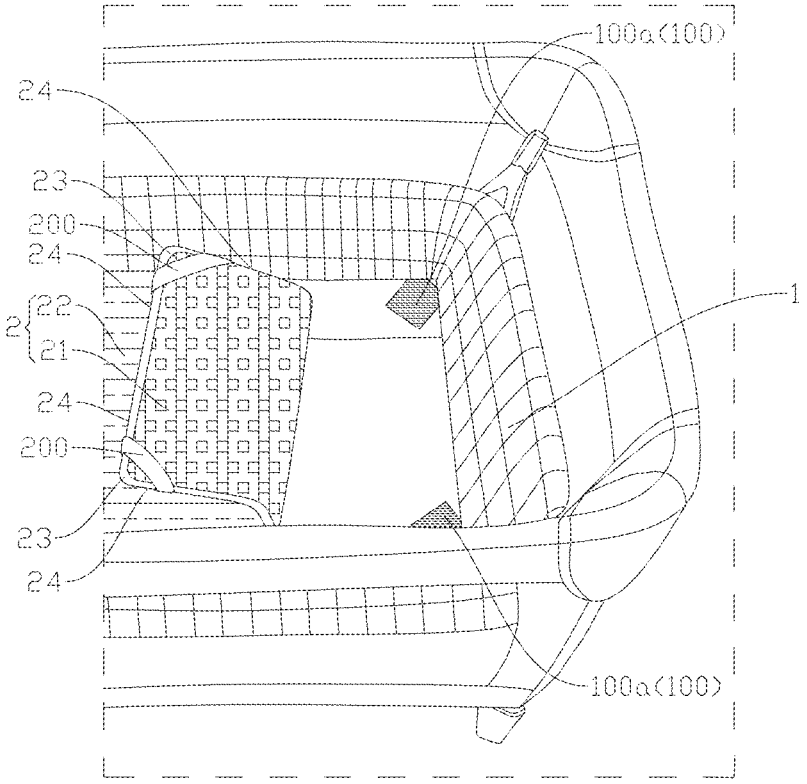
FIG. 7 is another partial perspective view of the child carrier shown in FIG. 1, with a second usage surface of the cushion being exposed and the cushion being partially folded.

In a first embodiment, as shown in FIGS. 4 and 5, the first connecting member 100 is a hook side of Velcro 100*a* fixed at each of the four corners of the bottom of the frame body 1. The second connecting member 200 is made of a material that can be bonded to the hook side of Velcro 100*a*, such as nylex. In this way, as shown in FIG. 6, when the first usage surface 21 of the cushion 2 is exposed for use, the second connecting members 200 are all located on the second usage surface 22. As such, the four second connecting members 200 can be bonded and fixed to the four first connecting members 100, respectively, so that the cushion 2 is firmly fixed to the frame body 1. Similarly, as shown in FIG. 7, when the second usage surface 22 of the cushion 2 is exposed for use, the second connecting members 200 are all located on the first usage surface 21. As such, the four second connecting members 200 can be bonded and fixed to the four first connecting members 100, respectively, so that the cushion 2 is firmly fixed to the frame body 1. In other embodiments, the first connecting member 100 may also be a loop side of Velcro, and the second connecting member 200 may be made of a material that can be bonded to the loop side of Velcro.

Figure 8:
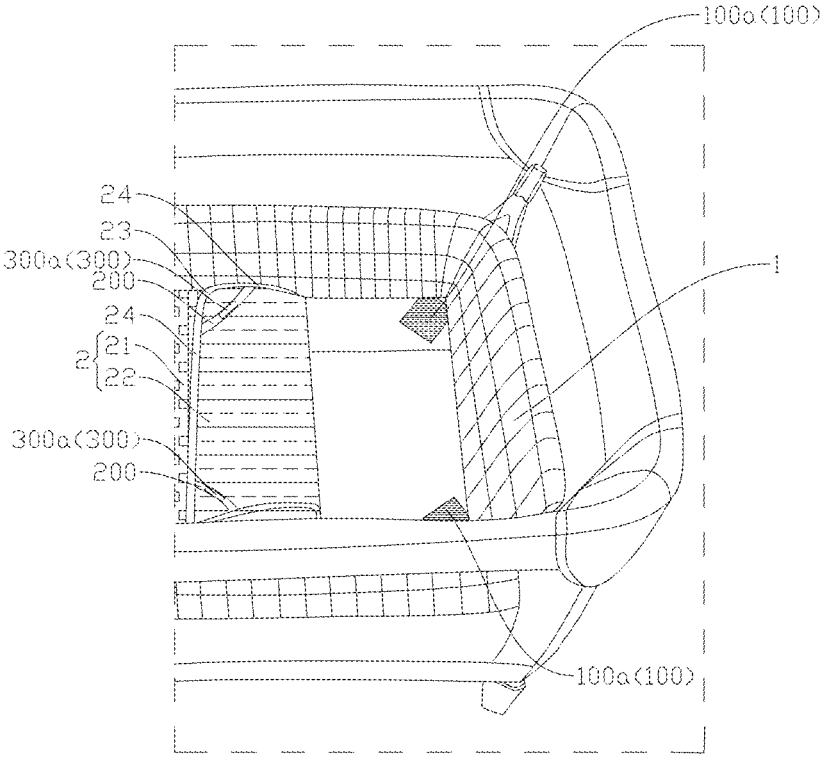
FIG. 8 is a partial perspective view of the child carrier according to a second embodiment of the present disclosure, with a first usage surface of the cushion being exposed for use and the cushion being partially folded, where a first fitting member and a second fitting member are loop sides of Velcro respectively; a first connecting member is a hook side of Velcro that can be bonded to the loop side of Velcro.
Figure 9:
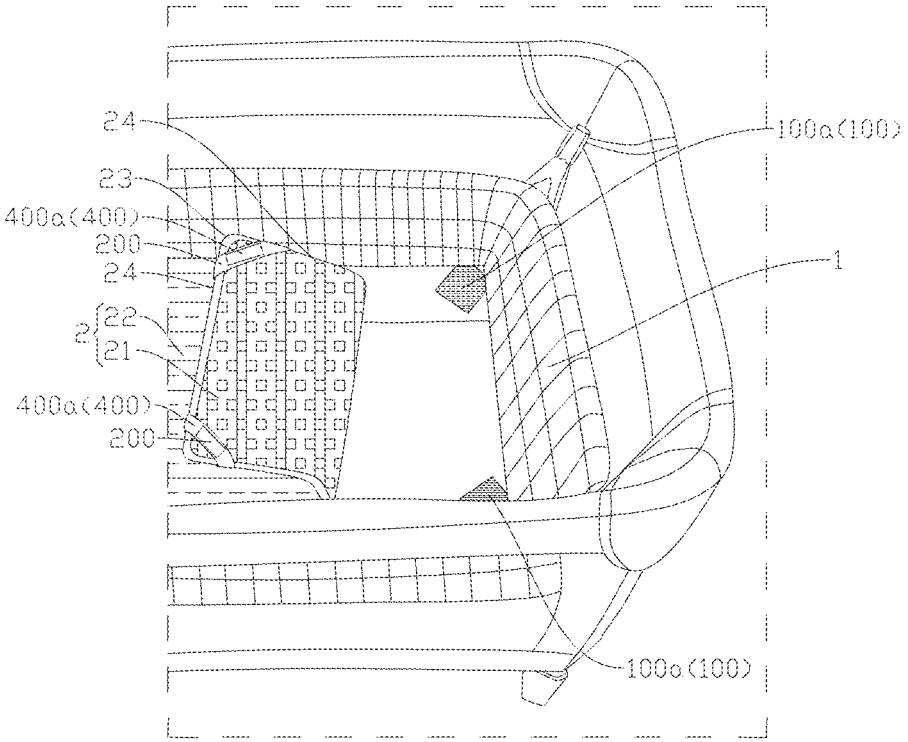
FIG. 9 is another partial perspective view of the child carrier according to the second embodiment of the present disclosure, with a second usage surface of the cushion being exposed for use and the cushion being partially folded; where the first fitting member and the second fitting member are the loop sides of Velcro, and the first connecting member is the hook side of Velcro.

In a second embodiment, a first fitting member 300 and a second fitting member 400 that can be detachably connected to the first connecting member 100, may also be provided on opposite sides of the second connecting member 200 respectively. As shown in FIGS. 8 and 9, the first fitting member 300 and the second fitting member 400 can be loop side of Velcro 300*a* (or 400*a*), and the first connecting member 100 is a hook side of Velcro 100*a* that can be bonded to the loop side of Velcro 300*a* (or 400*a*). As shown in FIG. 8, when the first usage surface 21 of the cushion 2 is exposed for use, the second connecting members 200 are all located on the second usage surface 22. As such, the first fitting members 300 of the four second connecting members 200 can be respectively bonded and fixed to the four first connecting member 100, so that the cushion 2 is firmly fixed to the frame body 1. Similarly, as shown in FIG. 9, when the second usage surface 22 of the cushion 2 is exposed for use, the second connecting members 200 are all located on the first usage surface 21. As such, the second fitting members 400 of the four second connecting members 200 can be respectively bonded and fixed to the four first connecting members 100, so that the cushion 2 is firmly fixed to the frame body 1. In other embodiments, the first connecting member 100 may also be a loop side of Velcro 300*a* (or 400*a*), and the first fitting member 300 and the second fitting member 400 may be hook sides of Velcro 100*a* that can be bonded to the loop side of Velcro 300*a* (or 400*a*).

Figure 10:
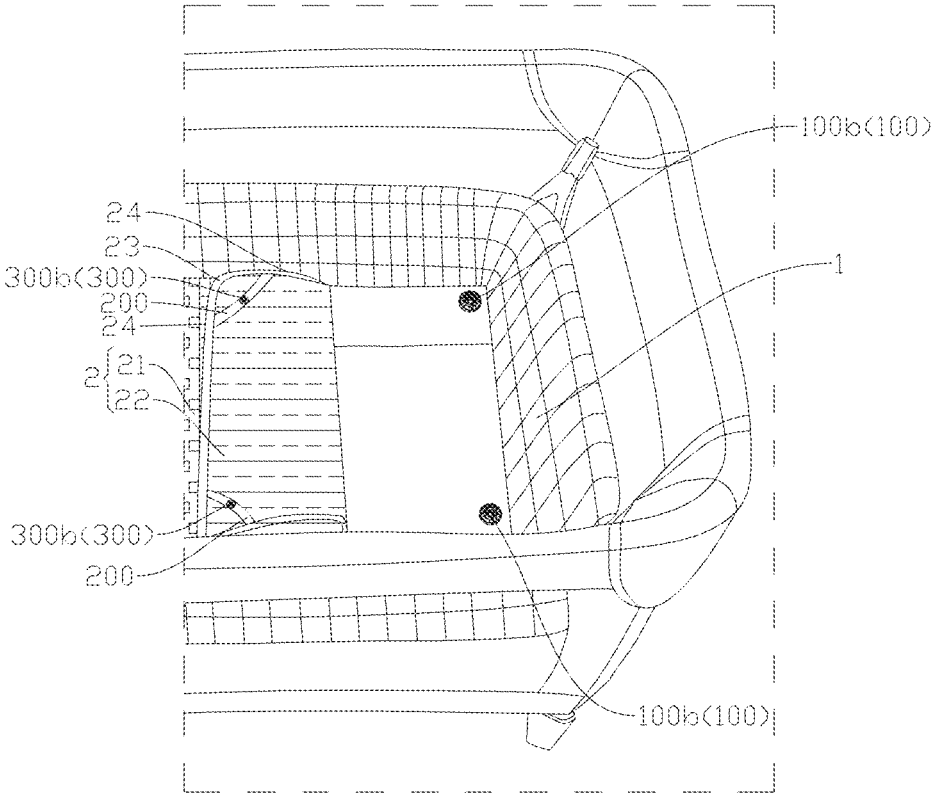
FIG. 10 is another partial perspective view of the child carrier according to the second embodiment of the present disclosure, with the first usage surface of the cushion being exposed for use and the cushion being partially folded, where the first fitting member and the second fitting member are female buckles, and the first connecting member is a male buckle.
Figure 11:
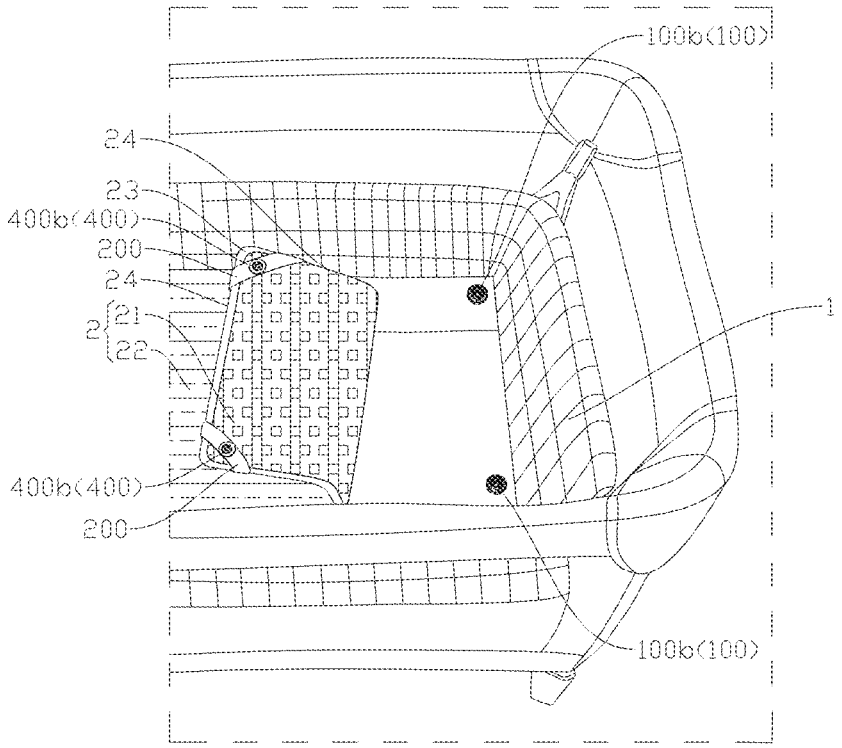
FIG. 11 is a partial perspective view of the child carrier according to the second embodiment of the present disclosure, with the second usage surface of the cushion being exposed for use and the cushion being partially folded, where the first fitting member and the second fitting member are female buckles, and the first connecting member is a male buckle.

As shown in FIGS. 10 and 11, the first fitting member 300 and the second fitting member 400 may also be female buckles 300*b* (or 400*b*), and the first connecting member 100 may be a male buckle 100*b* that can be buckled to the female buckle 300*b* (or 400*b*). As shown in FIG. 10, when the first usage surface 21 of the cushion 2 is exposed for use, the second connecting members 200 are all located on the second usage surface 22. As such, the first fitting members 300 of the four second connecting members 200 can be respectively buckled to the four first connecting members 100, so that the cushion 2 is firmly fixed to the frame body 1. Similarly, as shown in FIG. 11, when the second usage surface 22 of the cushion 2 is exposed for use, the second connecting members 200 are all located on the first usage surface 21. As such, the second fitting members 400 of the four second connecting members 200 can be respectively buckled to the four first connecting members 100, so that the cushion 2 is firmly fixed to the frame body 1. In other embodiments, the first connecting member 100 may also be a female buckle 300*b* (or 400*b*), and the first fitting member 300 and the second fitting member 400 may be male buckles that can be buckled to the female buckle 300*b* (or 400*b*).

In other embodiments, the first fitting member 300, the second fitting member 400, and the first connecting member 100 are not limited to be the hook side of Velcro 100*a*, the loop side of Velcro 300*a* (or 400*a*), the male buckle 100*b*, the female buckle 300*b* (or 400*b*), etc., but may also be, for example, hooks, and the first connecting member 100 may be, for example, a ring that can be engaged with the hook, etc. In short, the first fitting member 300, the second fitting member 400, and the first connecting member 100 can be any components that can facilitate detachable connection.

Figure 12:
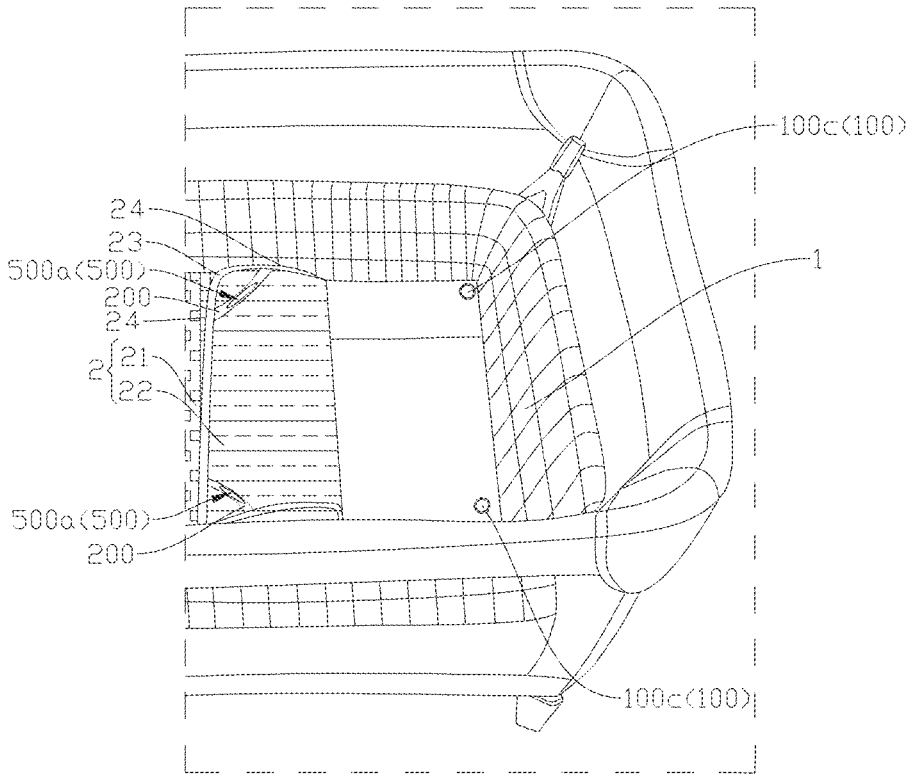
FIG. 12 is a partial perspective view of a child carrier according to a third embodiment of the present disclosure, with the first usage surface of the cushion being exposed for use and the cushion being partially folded.
Figure 13:
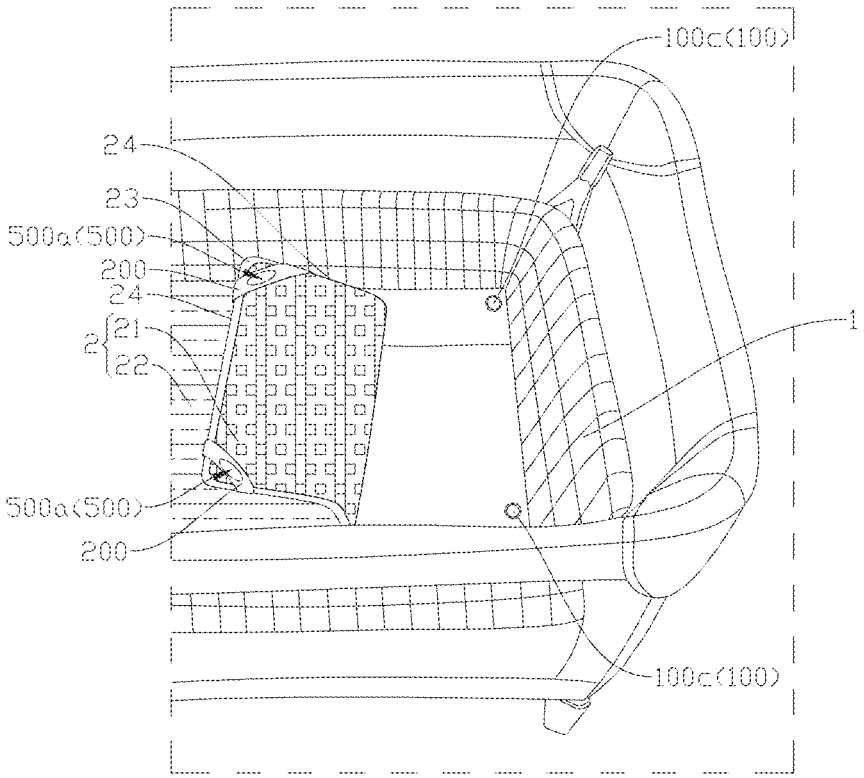
FIG. 13 is a partial perspective view of the child carrier according to the third embodiment of the present disclosure, with the second usage surface of the cushion being exposed for use and the cushion being partially folded.

In a third embodiment, the second connecting member 200 includes a third fitting member 500. When the second connecting member 200 is in the first usage state or the second usage state, the third fitting member 500 can be detachably connected to the first connecting member 100. Specifically, as shown in FIGS. 12 and 13, the first connecting member 100 is a button 100*c*, and the third fitting member 500 is a buttonhole 500*a* that can be fitted with the button 100*c*. Since the buttonhole 500*a* can extend through the second connecting member 200, the buttonhole 500*a* can be buckled to the button 100*c* regardless of whether the respective second connecting member 200 is in the first usage state or the second usage state. As such, it is not necessary to arrange the third fitting members 500 on opposite sides of the second connecting member 200, which can simplify the manufacturing process. As shown in FIG. 12, when the first usage surface 21 of the cushion 2 is exposed for use, the second connecting members 200 are all located on the second usage surface 22. As such, the third fitting members 500 of the four second connecting members 200 can be respectively buckled to the four first connecting members 100, so that the cushion 2 is firmly fixed to the frame body 1. Similarly, as shown in FIG. 13, when the second usage surface 22 of the cushion 2 is exposed for use, the second connecting members 200 are all located on the first usage surface 21. As such, the third fitting members 500 of the four second connecting members 200 can be respectively buckled to the four first connecting members 100, so that the cushion 2 is firmly fixed to the frame body 1.

In other embodiments, as shown in FIGS. 14 to 21, the first connecting member 100 is a ring-shaped member 100*d* arranged on the frame body 1 (or at the bottom of the hammock). The second connecting member 200 is strip-shaped. One end of the second connecting member 200 is connected to the cushion 2, and another end of the second connecting member 200 is a free end 210. Specifically, the first end of the second connecting member 200 is sewn at the corner 23 of the cushion 2 and at the junction of the first usage surface 21 and the second usage surface 22 of the cushion 2. In other embodiments, the first end of the second connecting member 200 may also be sewn to the first usage surface 21 or the second usage surface 22 of the cushion 2. In this embodiment, four first connecting members 100 are provided. The four first connecting members 100 are respectively arranged at the four corners of the bottom of the frame body 1. Four second connecting members 200 are provided. The four second connecting members 200 are respectively arranged at the four corners 23 of the cushion 2. In other embodiments, the number and arrangement positions of the first connecting members 100 and the second connecting members 200 may also be adjusted as needed. In one embodiment, the child carrier further includes a fourth fitting member 600 and a fifth fitting member 700 that are spaced apart and provided on the second connecting member 200. In this case, when the second connecting member 200 is in the first usage state or the second usage state, the free end 210 of the second connecting member 200 can extend through the ring-shaped member 100*d* and be fixed to the ring-shaped member 100*d*, through the detachable connection of the fourth fitting member 600 and the fifth fitting member 700.

Figure 14:
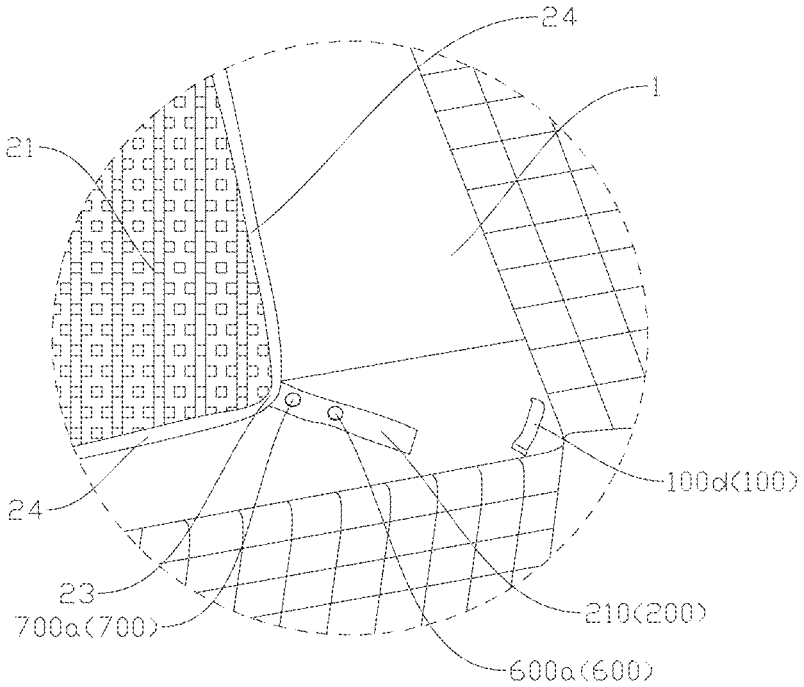
FIG. 14 is a partial perspective view of the child carrier according to a fourth embodiment of the present disclosure, with the first usage surface of the cushion being exposed for use and the first connecting member being not connected to the second connecting member, where a fifth fitting member is a male buckle, and a sixth fitting part is the female buckle.
Figure 15:
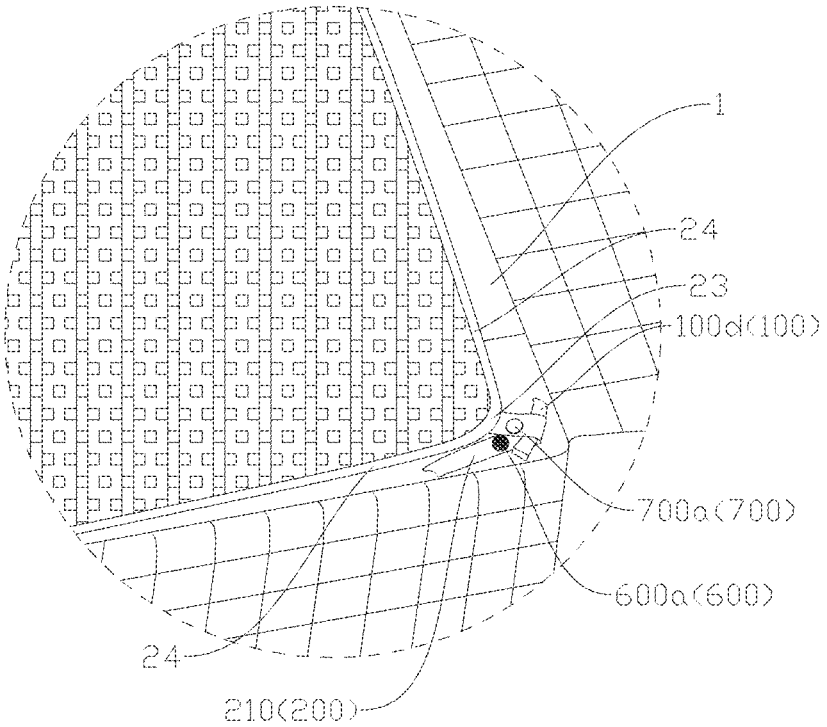
FIG. 15 is a partial perspective view of the child carrier according to the fourth embodiment of the present disclosure, with the first usage surface of the cushion being exposed for use, and the first connecting member and the second connecting member being in the process of being connected, where the fifth fitting member is a male buckle, and the sixth fitting part is a female buckle.
Figure 16:
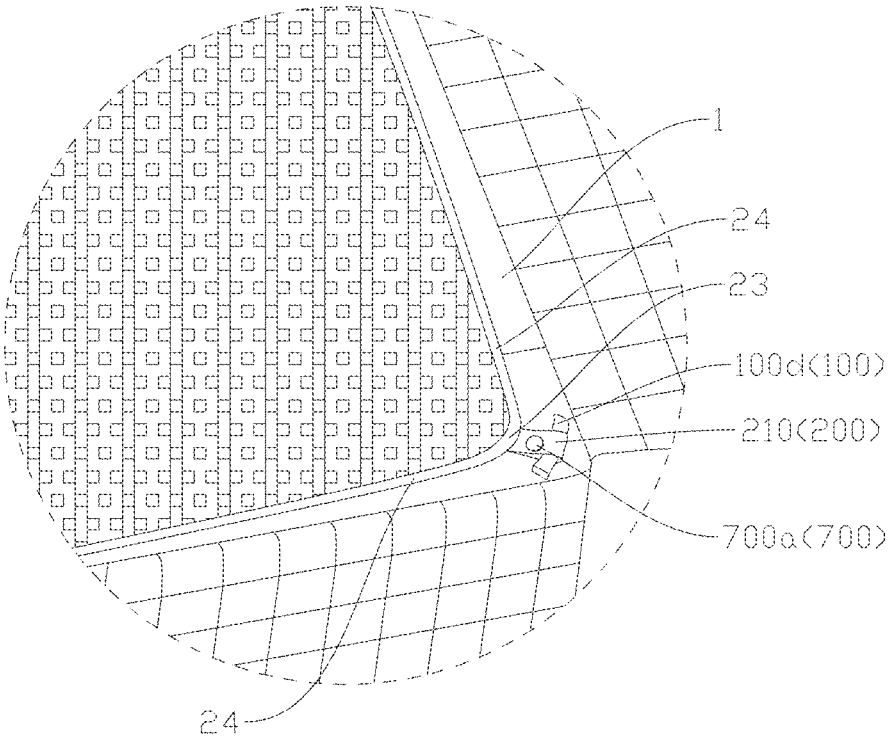
FIG. 16 is a partial perspective view of the child carrier according to the fourth embodiment of the present disclosure, with the first usage surface of the cushion being exposed for use and the first connecting member being connected to the second connecting member, where the fifth fitting member is a male buckle, and the sixth fitting part is the female buckle.
Figure 17:
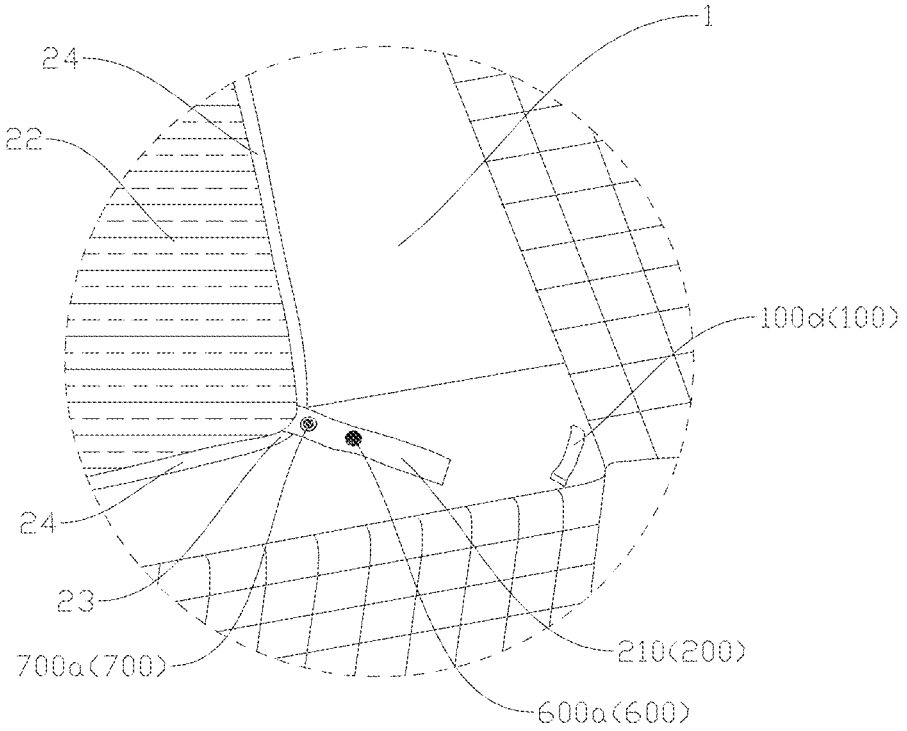
FIG. 17 is a partial perspective view of the child carrier according to the fourth embodiment of the present disclosure, with the second usage surface of the cushion being exposed for use and the first connecting member being not connected to the second connecting member, where the fifth fitting member is a male buckle, and the sixth fitting part is a female buckle.
Figure 18:
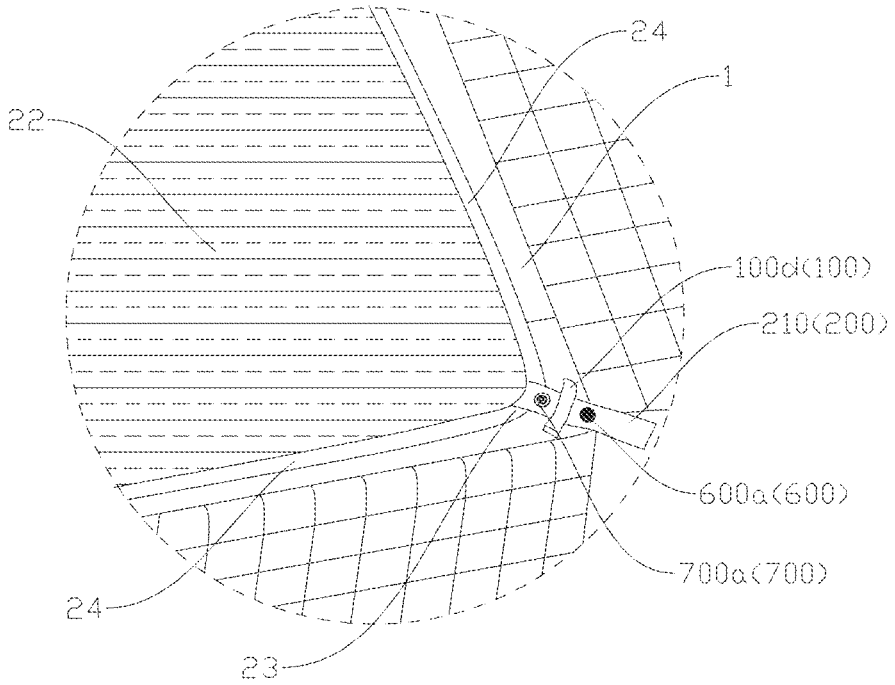
FIG. 18 is a partial perspective view of the child carrier according to the fourth embodiment of the present disclosure, with the second usage surface of the cushion being exposed for use, and the first connecting member and the second connecting member being in the process of being connected, where the fifth fitting member is a male buckle, and the sixth fitting part is a female buckle.
Figure 19:
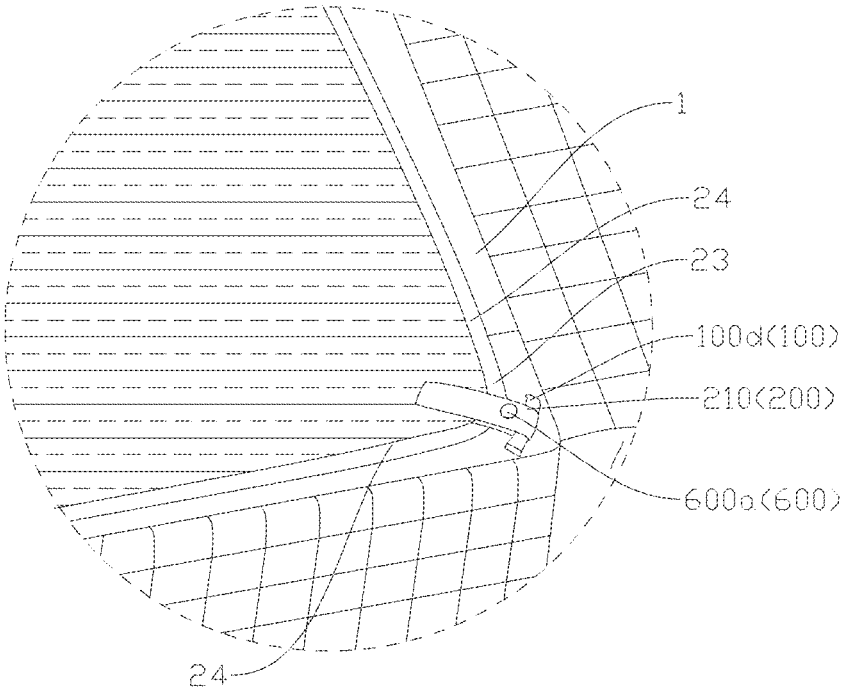
FIG. 19 is a partial perspective view of the child carrier according to the fourth embodiment of the present disclosure, with the second usage surface of the cushion being exposed for use and the first connecting member being connected to the second connecting member, where the fifth fitting member is a male buckle, and the sixth fitting part is the female button.

In as fourth embodiment, as shown in FIGS. 14 to 19, one of the fourth fitting member 600 and the fifth fitting member 700 is a male buckle 600*a*, and the other of the fourth fitting member 600 and the fifth fitting member 700 is a female buckle 700*a* that can cooperate with the male buckle 600*a*. As shown in FIGS. 14 to 16, when the first usage surface 21 of the cushion 2 is exposed for use, the free end 210 of the second connecting member 200 extends through the first connecting member 100 from top to bottom, that is, the fourth fitting member 600 is located below the ring-shaped member 100*d*, and the fifth fitting member 700 is located above the ring-shaped member 100*d*. The fourth fitting member 600 and the fifth fitting member 700 can be buckled to each other, so as to fix the cushion 2 to the frame body 1. As shown in FIGS. 17 to 19, when the second usage surface 22 of the cushion 2 is exposed for use, the free end 210 of the second connecting member 200 extends through the first connecting member 100 from bottom to top, that is, the fourth fitting member 600 is located above the ring-shaped member 100*d*, and the fifth fitting member 700 is located below the ring-shaped member 100*d*. The fourth fitting member 600 and the fifth fitting member 700 can be buckled to each other, so as to fix the cushion 2 to the frame body 1.

Figure 20:
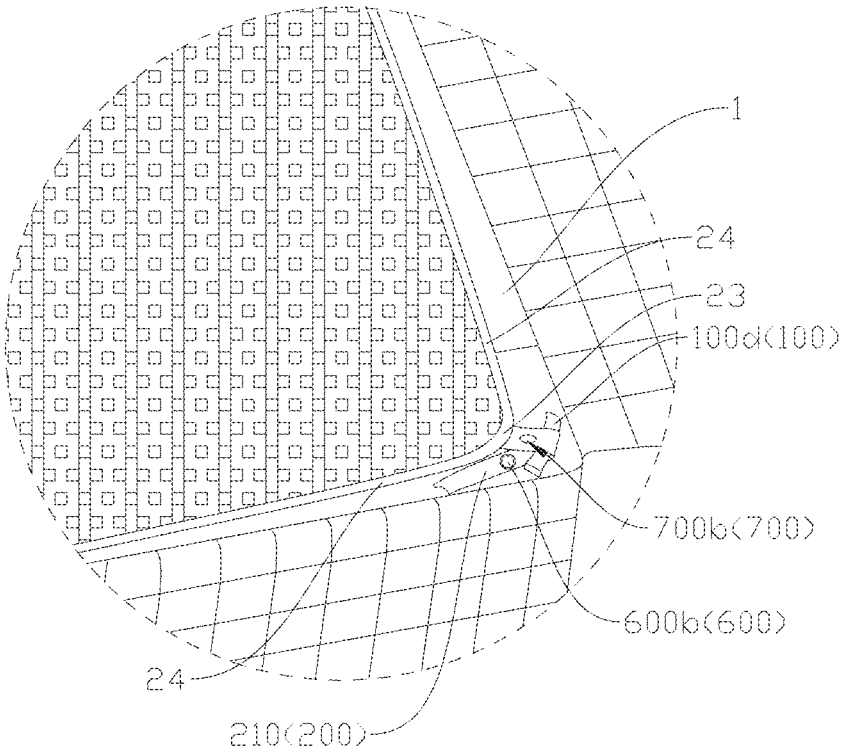
FIG. 20 is a partial perspective view of the child carrier according to the fourth embodiment of the present disclosure, with the first usage surface of the cushion being exposed for use, and the first connecting member and the second connecting member being in the process of being connected, where the fifth fitting member is a button, and the sixth fitting part is a buttonhole.
Figure 21:
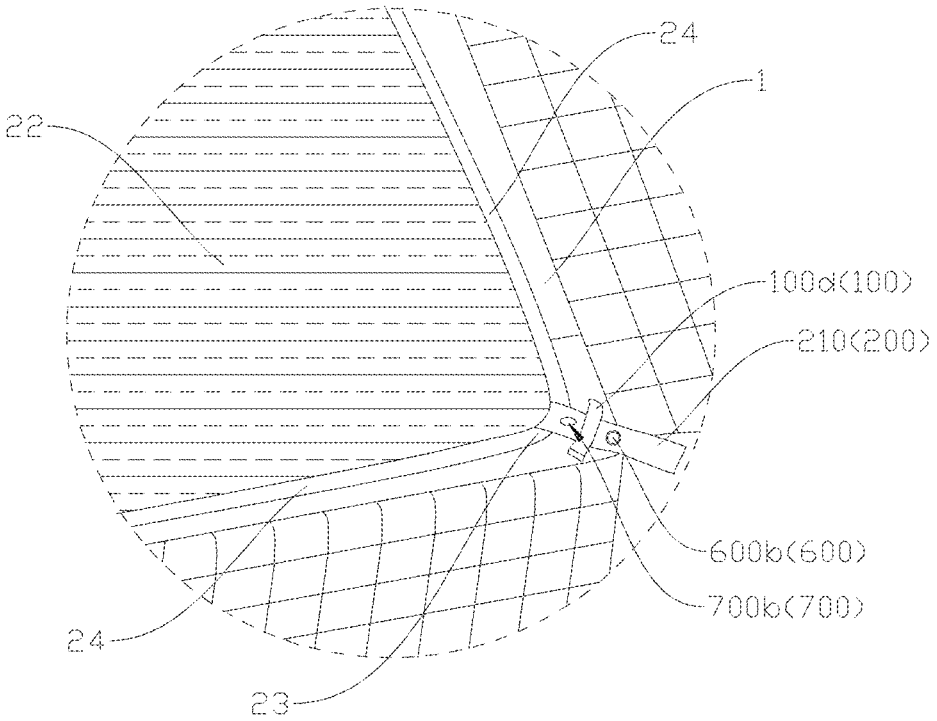
FIG. 21 is a partial perspective view of the child carrier according to the fourth embodiment of the present disclosure, with the second usage surface of the cushion being exposed for use, and the first connecting member and the second connecting member being in the process of being connected, where the fifth fitting member is a button, and the sixth fitting part is a buttonhole.

As shown in FIGS. 20 and 21, one of the fourth fitting member 600 and the fifth fitting member 700 is a button 600*b*, and the other of the fourth fitting member 600 and the fifth fitting member 700 is a buttonhole 700*b* that can be buckled to the button 600*b*. As shown in FIG. 20, when the first usage surface 21 of the cushion 2 is exposed for use, the free end 210 of the second connecting member 200 extends through the first connecting member 100 from top to bottom, that is, the fourth fitting member 600 is located below the ring-shaped member 100*d*, and the fifth fitting member 700 is located above the ring-shaped member 100*d*. The fourth fitting member 600 and the fifth fitting member 700 are buckled to each other to fix the cushion 2 to the frame body 1. As shown in FIG. 21, when the second usage surface 22 of the cushion 2 is exposed for use, the free end 210 of the second connecting member 200 extends through the first connecting member 100 from bottom to top, that is, the fourth fitting member 600 is located above the ring-shaped member 100*d*, the fifth fitting member 700 is located below the ring-shaped member 100*d*. The fourth fitting member 600 and the fifth fitting member 700 are buckled to each other to fix the cushion 2 to the frame body 1.

Figure 22:
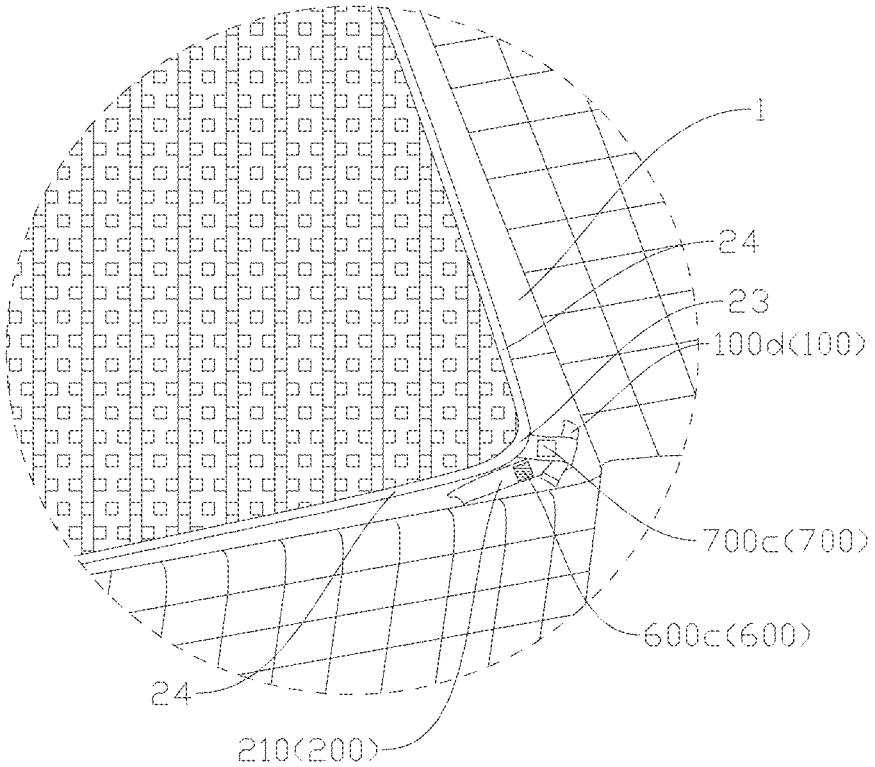
FIG. 22 is a partial perspective view of the child carrier according to the fourth embodiment of the present disclosure, with the first usage surface of the cushion being exposed for use, and the first connecting member and the second connecting member being in the process of being connected, where the fifth fitting member is a hook side of Velcro, and the sixth fitting part is a loop side of Velcro.
Figure 23:
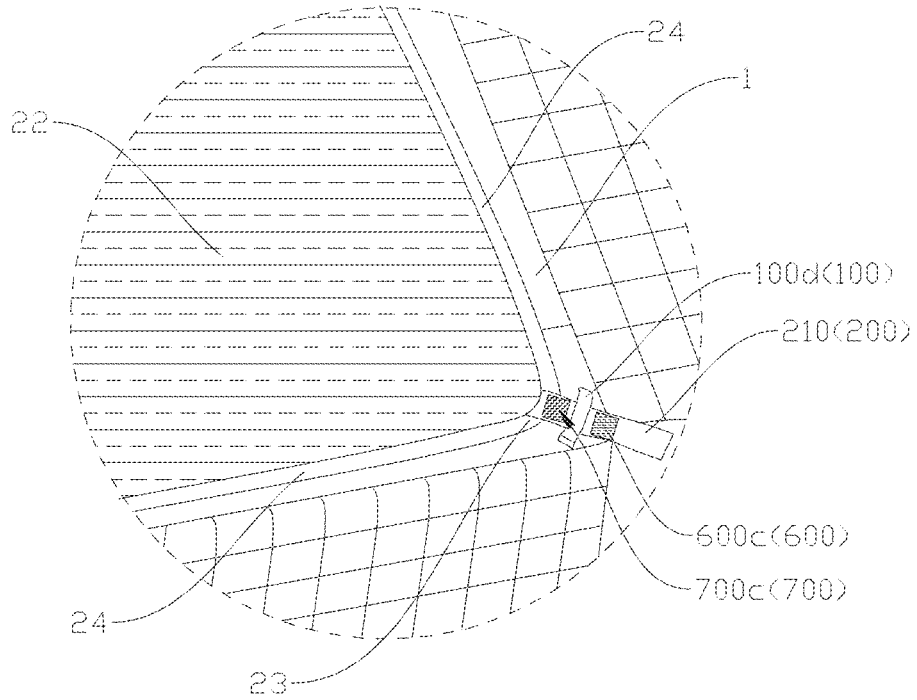
FIG. 23 is a partial perspective view of the child carrier according to the fourth embodiment of the present disclosure, with the second usage surface of the cushion being exposed for use, and the first connecting member and the second connecting member being in the process of being connected, where the fifth fitting member is the hook side of Velcro, and the sixth fitting part is the loop side of Velcro.

As shown in FIGS. 22 and 23, one of the fourth fitting member 600 and the fifth fitting member 700 is a hook side of Velcro 600*c*, and the other of the fourth fitting member 600 and the fifth fitting member 700 is a loop side of Velcro 700*c* that can be bonded to the hook side of Velcro 600*c*. As shown in FIG. 22, when the first usage surface 21 of the cushion 2 is exposed for use, the free end 210 of the second connecting member 200 extends through the first connecting member 100 from top to bottom, that is, the fourth fitting member 600 is located below the ring-shaped member 100*d*, and the fifth fitting member 700 is located above the ring-shaped member 100*d*. The fourth fitting member 600 and the fifth fitting member 700 are bonded to each other to fix the cushion 2 to the frame body 1. As shown in FIG. 23, when the second usage surface 22 of the cushion 2 is exposed for use, the free end 210 of the second connecting member 200 extends through the first connecting member 100 from bottom to top, that is, the fourth fitting member 600 is located above the ring-shaped member 100*d*, the fifth fitting member 700 is located below the ring-shaped member 100*d*. The fourth fitting member 600 and the fifth fitting member 700 are bonded to each other to fix the cushion 2 to the frame body 1.

In other embodiments, the fourth fitting member 600 and the fifth fitting member 700 are not limited to the above embodiments. For example, the fourth fitting member 600 and the fifth fitting member 700 may be any components that facilitates detachable connection. By utilizing different modes of the second connecting members 200*s* extending through the ring-shaped members 100*d*, the cushion 2 can be firmly fixed to the frame body 1 regardless of whether the first usage surface 21 or the second usage surface 22 is exposed for use.

Figure 24:
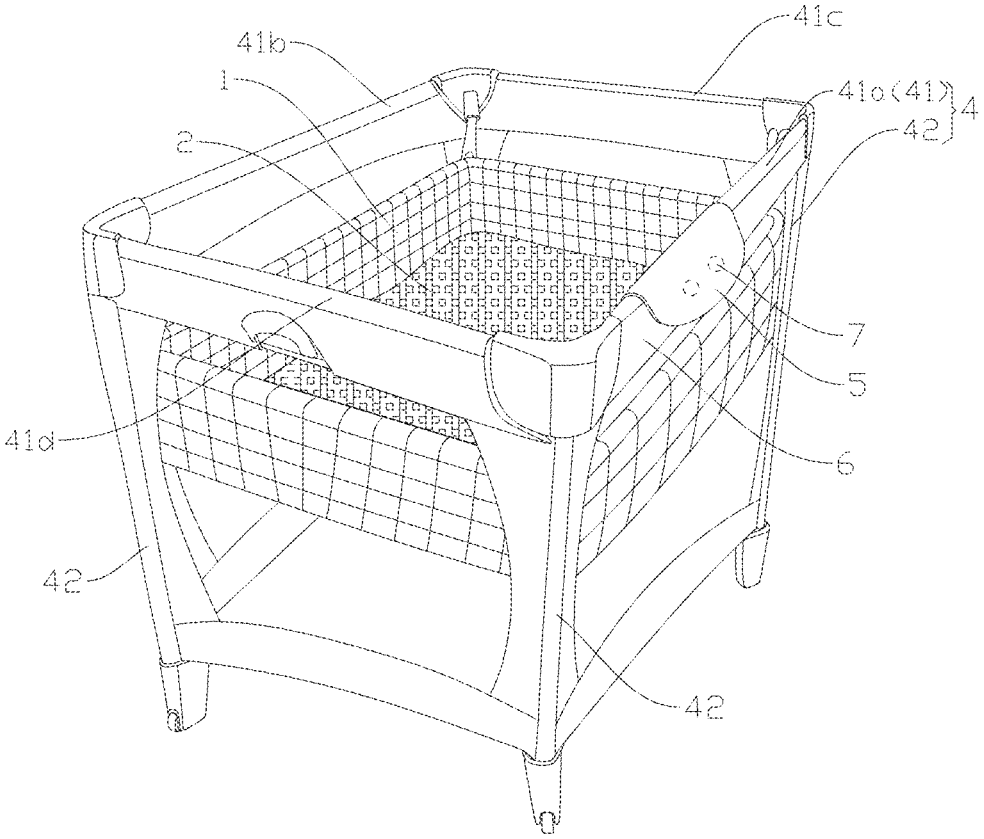
FIG. 24 is a perspective view of a child carrier according to another embodiment of the present disclosure, with a shielding member shielding an operating joint.

In a further embodiment, as shown in FIG. 24, the bed frame 4 has a generally cubic frame structure, specifically including four guard rods 41 and four support columns 42. The four guard rods 41 are connected end to end to form a rectangular frame structure. Two of the guard rods 41 form the long edges of the rectangular frame structure, denoted as a first guard rod 41*a* and the second guard rod 41*b*. The other two of the guard rods 41 form the short edges of the rectangular frame structure, denoted as a third guard rod 41*c* and a fourth guard rod 41*d*. The four support columns 42 are respectively provided at the bottom of the four corners of the rectangular frame structure. The child carrier further includes a cloth cover 6. The cloth cover 6 wraps around the bed frame 4 to form an accommodation space for accommodating a hammock or a child. That is, the child can sit inside the hammock in the crib. Alternatively, the hammock can be omitted, and the child sit directly in the accommodation space formed by the cloth cover 6 and the bed frame 4. It should be noted that the guard rods 41 and the support column 42 shown in FIGS. 24 to 26 are both wrapped by cloth covers 6, so their corresponding reference numerals are actually marked on the cloth covers 6 wrapping around the guard rods 41 and the support columns 42 respectively.

Further, the child carrier further includes an operating joint 43. The first guard rod 41*a*, the second guard rod 41*b*, the third guard rod 41*c* and the fourth guard rod 41*d* are all composed of two connecting rods pivoted to each other, and the two connecting rods are pivotally connected to each other by the operating joint 43. The operating joint 43 is configured to be operable to pivot the two connecting rods and ultimately collapse the entire bed frame 4.

Figure 25:
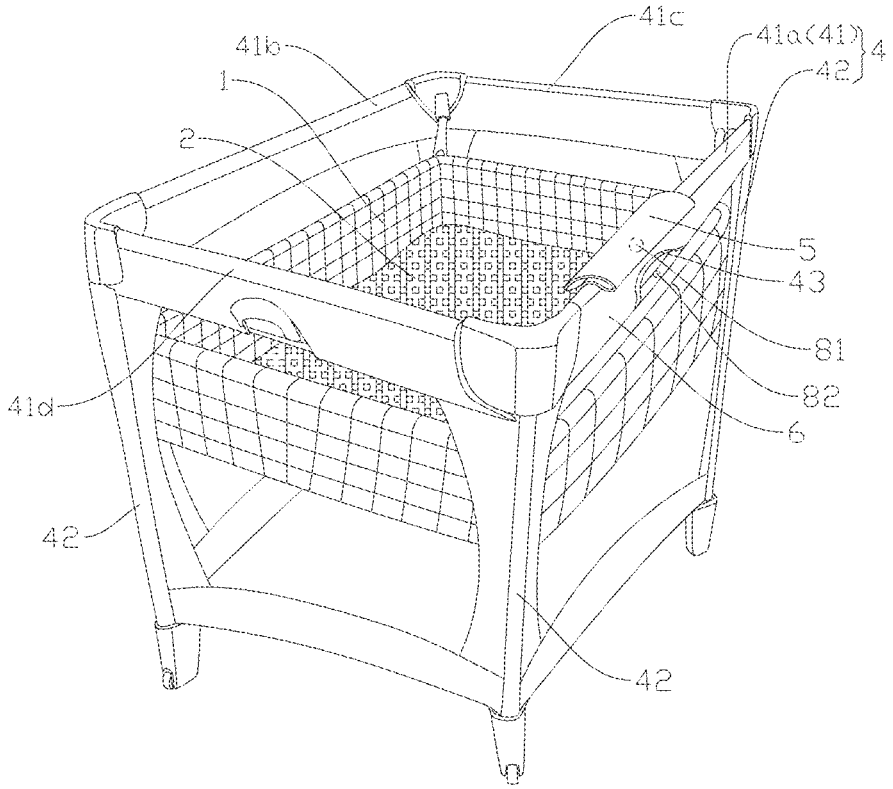
FIG. 25 is another perspective view of the child carrier shown in FIG. 24, with the shielding member being turned over and not shielding the operating joint.
Figure 26:
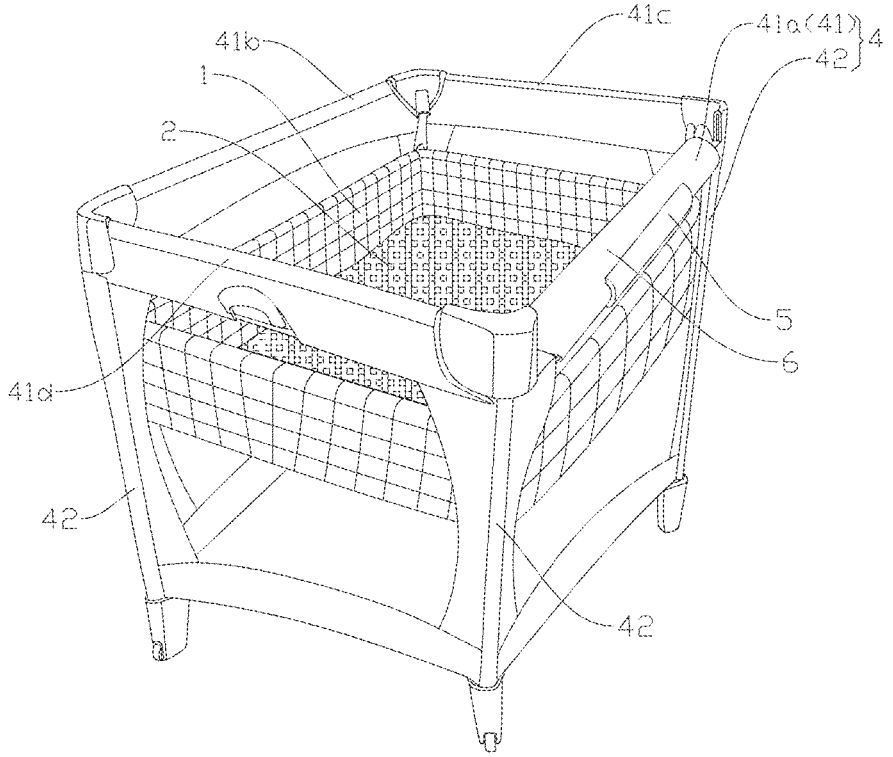
FIG. 26 is another perspective view of the child carrier shown in FIG. 24, with a height of a first guard rod being lowered.

Further, as shown in FIGS. 24 and 25, the child carrier further includes a shielding member 5. The shielding member 5 can shield the operating joint 43. In one embodiment, the shielding member 5 can selectively shield the side of the operating joint 43 facing the outer side of the bed frame 4. In this way, when the child carrier is used adjacent to an adult bed, the shielding member 5 can prevent an adult from accidentally colliding with the operating joint 43, or prevent an adult from accidentally unlocking the operating joint 43 and causing the two connecting rods of the guard rod 41 to pivot, and resulting in the unstable support of the bed frame 4. Specifically, the shielding member 5 can be flipped and connected to the guard rod 41. For example, the shielding member 5 can be a roughly rectangular cloth piece. One side of the shielding member 5 is sewn on the cloth cover 6 that wraps around the guard rod 41. In this way, as shown in FIG. 25, when it is necessary to operate the operating joint 43, the shielding member 5 can only be turned over to the inner side of the bed frame 4 to expose the operating joint 43. As shown in FIG. 24, when it is not necessary to operate the operating joint 43, the shielding member 5 can only be turned over to the outer side of the bed frame 4 to cover the operating joint 43. The operation is simple and the production process is simple.

In this embodiment, as shown in FIGS. 24 and 25, the shielding member 5 is further provided with a magnetic member 7. The operating joint 43 is made of ferromagnetic material. When the shielding member 5 shields the surface of the operating joint 43 facing the outer side of the bed frame 4, the magnetic member 7 can cooperate with the operating joint 43 to fix the shielding member 5 to the surface of the operating joint 43 facing the outer side of the bed frame 4. Such an arrangement can ensure that when the operating joint 43 is not in use, the shielding member 5 can firmly cover the operating joint 43 and the shielding member 5 is not easily turned over.

In other embodiments, a first fixing member 81 (as shown in FIG. 25) may also be provided on the shielding member 5 and a second fixing member 82 (as shown in FIG. 25) may be provided on the operating joint 43. When the shielding member 5 shields the surface of the operating joint 43 facing the outer side of the bed frame 4, the first fixing member 81 can be detachably connected to the second fixing member 82 to fix the shielding member 5 to the surface of the operating joint 43 facing the outer side of the bed frame 4. The first fixing member 81 and the second fixing member 82 may have various forms. For example, the first fixing member 81 may be a first magnetic member, and the second fixing member 82 may be a second magnetic member capable of attracting and cooperating with the first magnetic member. Alternatively, one of the first fixing member 81 and the second fixing member 82 may be a hook side of Velcro, and another of the first fixing member 81 and the second fixing member 82 may be a loop side of Velcro that can be bonded to the hook side of Velcro. Alternatively, one of the first fixing member 81 and the second fixing member 82 may be a male buckle, and another of the first fixing member 81 and the second fixing member 82 may be a female buckle that can be buckled to the male buckle, and so on. In short, as long as the first fixing member 81 and the second fixing member 82 can be in a detachable cooperation.

Further, as shown in FIGS. 25 and 26, the height of at least one of the first guard rod 41*a*, the second guard rod 41*b*, the third guard rod 41*c* and the fourth guard rod 41*d* is adjustable. In this embodiment, the first guard rod 41*a* is adjustable. The operating joint 43 is provided on at least one of the first guard rod 41*a*, the second guard rod 41*b*, the third guard rod 41*c* and the fourth guard rod 41*d*, and the operating joint 43 may be operable to make the height of the corresponding guard rod adjustable. The first guard rod 41*a* can slide relative to the two support columns 42 connected to its two ends, thereby realizing the height adjustment of the first guard rod 41*a*. The shielding member 5 is located on a side of the first guard rod 41*a*, and when it is required to operate the operating joint 43, the shielding member 5 needs to be turned over to uncover the operating joint 43 before the operation can be performed.

In the above-mentioned child carrier, the frame body 1 is provided with the first connecting member 100, and the cushion 2 is provided with the second connecting member 200. The second connecting member 200 has two usage states. The second connecting member 200 can be connected to the first connecting member 100 when it is in the first usage state, so that the first usage surface 21 of the cushion 2 is exposed for use. The second connecting member 200 can be connected to the first connecting member 100 when it is in the second usage state, so that the second usage surface 22 of the cushion 2 is exposed for use. In this way, the cushion 2 can be firmly fixed to the frame body 1 for use regardless of whether the first usage surface 21 or the second usage surface 22 is exposed for use, and the user experience is better.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present disclosure.

The above-described embodiments are only several implementations of the present disclosure, and the descriptions are relatively specific and detailed, but they should not be construed as limiting the scope of the present disclosure. It should be understood by those of ordinary skill in the art that various variants and improvements can be made without departing from the concept of the present disclosure, and all fall within the protection scope of the present disclosure. Therefore, the patent protection of the present disclosure shall be subjected to the appended claims.

The invention claimed is:

1. A child carrier, comprising:

a frame body;

a cushion provided on the frame body and comprising a first usage surface and a second usage surface that are arranged oppositely; and a fixing structure comprising a first connecting member provided on the frame body and a second connecting member provided on the cushion, the first connecting member being detachably connected to the second connecting member, the second connecting member being capable of switching between a first usage state and a second usage state;

wherein when the second connecting member is in the first usage state, the second connecting member is connected to the first connecting member to expose the first usage surface; and when the second connecting member is in the second usage state, the second connecting member is connected to the first connecting member to expose the second usage surface;

wherein, when the second connecting member is in the first usage state, the second connecting member is located on the second usage surface, and when the second connecting member is in the second usage state, the second connecting member is located on the first usage surface;

wherein the cushion comprises a corner, the second connecting member is strip-shaped, two ends of the second connecting member are fixed to two edges forming the corner, respectively, and a middle portion of the second connecting member is capable of crossing over the corner to switch between the first usage state and the second usage state.

2. The child carrier according to claim 1, wherein at least two second connecting members are provided, at least two corners are provided, and two ends of each second connecting member are fixed to the two edges forming the corresponding corner, respectively.

3. The child carrier according to claim 1, wherein the two ends of the second connecting member are sewn to the two edges forming the corner, respectively.

4. The child carrier according to claim 1, wherein a first fitting member and a second fitting member are provided on opposite sides of the second connecting member respectively, wherein the first fitting member and the second fitting member are detachably connected to the first connecting member.

5. The child carrier according to claim 4, wherein the first fitting member and the second fitting member are loop sides of hook and loop fasteners, and the first connecting member is a hook side of hook and loop fasteners; or the first fitting member and the second fitting member are hook sides of hook and loop fasteners, and the first connecting member is a loop side of hook and loop fasteners; or the first fitting member and the second fitting member are female buckles, and the first connecting member is a male buckle; or the first fitting member and the second fitting member are male buckles, and the first connecting member is a female buckle; or the first fitting member and the second fitting member are rings, and the first connecting member is a hook; or the first fitting member and the second fitting member are hooks, and the first connecting member is a ring.

6. The child carrier according to claim 1, wherein the second connecting member comprises a third fitting member, wherein when the second connecting member is in the first usage state or the second usage state, the third fitting member is detachably connected to the first connecting member.

7. The child carrier according to claim 6, wherein the first connecting member is a button, and the third fitting member is a buttonhole fitted with the button.

8. The child carrier according to claim 1, wherein the first connecting member is a hook side of hook and loop fasteners, and the second connecting member is made of a material that is capable of being bonded to the hook side of hook and loop fasteners.

9. The child carrier according to claim 8, wherein the second connecting member is made of a nylon fabric.

10. The child carrier according to claim 1, wherein the second connecting member is strip-shaped, one end of the second connecting member is connected to the cushion, and another end of the second connecting member is a free end; the child carrier further comprises a fourth fitting member and a fifth fitting member that are spaced apart and provided on the second connecting member; the first connecting member is a ring-shaped member provided on the frame body;

wherein when the second connecting member is in the first usage state or the second usage state, the free end extends through and is fixed to the ring-shaped member through a detachable connection of the fourth fitting member and the fifth fitting member.

11. The child carrier according to claim 10, wherein one of the fourth fitting member and the fifth fitting member is a male buckle, and another of the fourth fitting member and the fifth fitting member is a female buckle; or one of the fourth fitting member and the fifth fitting member is a button, and another of the fourth fitting member and the fifth fitting member is a buttonhole; or one of the fourth fitting member and the fifth fitting member is a hook side of hook and loop fasteners, and another of the fourth fitting member and the fifth fitting member is a loop side of hook and loop fasteners.

12. A child carrier, comprising:

a frame body being a hammock, and the child carrier being a crib;

a cushion provided on the frame body and comprising a first usage surface and a second usage surface that are arranged oppositely;

a fixing structure comprising a first connecting member provided on the frame body and a second connecting member provided on the cushion, the first connecting member being detachably connected to the second connecting member, the second connecting member being capable of switching between a first usage state and a second usage state;

wherein when the second connecting member is in the first usage state, the second connecting member is connected to the first connecting member to expose the first usage surface; and when the second connecting member is in the second usage state, the second connecting member is connected to the first connecting member to expose the second usage surface;

a bed frame comprising a guard rod and an operating joint, wherein the hammock is suspended inside the bed frame, and the operating joint is configured to collapse the guard rod or adjust a height of the guard rod; and a shielding member selectively shielding the operating joint.

13. The child carrier according to claim 12, wherein the shielding member is connected to the guard rod and is capable of being flipped.

14. The child carrier according to claim 12, wherein the guard rod is wrapped by a cloth cover, a side of the shielding member is sewn to the cloth cover.

15. The child carrier according to claim 12, wherein a first fixing member is provided on the shielding member, and a second fixing member is provided on the operating joint;

wherein when the shielding member shields a surface of the operating joint facing an outer side of the bed frame, the first fixing member is detachably connected to the second fixing member to fix the shielding member to the surface of the operating joint facing the outer side of the bed frame.

16. The child carrier according to claim 15, wherein the first fixing member is a first magnetic member, and the second fixing member is a second magnetic member capable of attracting the first magnetic member; or one of the first fixing member and the second fixing member is a hook side of hook and loop fasteners, and another of the first fixing member and the second fixing member is a loop side of hook and loop fasteners capable of being bonded to the hook side of hook and loop fasteners; or one of the first fixing member and the second fixing member is a male buckle, and another of the first fixing member and the second fixing member is a female buckle capable of being buckled to the male buckle.

17. The child carrier according to claim 12, wherein the shielding member is provided with a magnetic member, and the operating joint is made of ferromagnetic material;

wherein when the shielding member shields a surface of the operating joint facing an outer side of the bed frame, the magnetic member cooperates with the operating joint to fix the shielding member to the surface of the operating joint facing the outer side of the bed frame.

* * * * *